United States Patent [19]

Sewell et al.

[11] Patent Number: 4,907,209

[45] Date of Patent: Mar. 6, 1990

[54] LOW FREQUENCY SOUND TRANSDUCER

[75] Inventors: John M. Sewell, Baltimore; William F. Werner, Severn, both of Md.

[73] Assignee: Martin Marietta Corporation, Bethesda, Md.

[21] Appl. No.: 334,767

[22] Filed: Apr. 10, 1989

Related U.S. Application Data

[63] Continuation of Ser. No. 547,109, Oct. 11, 1983, abandoned.

[51] Int. Cl.[4] ..... H04R 15/00

[52] U.S. Cl. ..... 367/168; 367/156; 310/26

[58] Field of Search ..... 310/26, DIG. 1; 367/156, 158, 168, 189

[56] References Cited

U.S. PATENT DOCUMENTS

| | | | |
|---|---|---|---|
| 2,076,330 | 4/1937 | Wood et al. | 367/168 |
| 2,468,270 | 4/1949 | Olson | 367/168 |
| 2,607,814 | 8/1952 | Bloch | 367/168 X |
| 3,160,769 | 12/1964 | Abbott | 310/26 |
| 3,177,382 | 4/1965 | Green | 310/26 X |
| 3,263,768 | 8/1966 | Zepernick | 367/168 |
| 3,484,630 | 12/1969 | Schwartz | 310/26 |
| 3,906,435 | 9/1975 | Lamel et al. | 367/81 |
| 4,308,603 | 12/1981 | Overby, III | 310/26 X |
| 4,438,509 | 3/1984 | Butler et al. | 367/168 X |
| 4,541,081 | 9/1985 | Smith | 310/26 X |
| 4,685,091 | 8/1987 | Chung et al. | 367/31 |

OTHER PUBLICATIONS

Woollett, "Relation of Basic Material Properties to Operating Transducer Parameters", U.S. Navy Journal of Underwater Acoustics, vol. 27, No. 1, pp. 25–37.

Butler et al., "Development of Two Rare-Earth Transducers", U.S. Navy Journal of Underwater Acoustics, vol. 27, No. 1, Jan. 1977, pp. 165–174.

U.S. Navy Journal of Underwater Acoustics, "Design of a Transducer Using Rear-Earth Magnetostrictive Materials"—Robert R. Smith and James C. Logan, vol. 27, No. 1, Jan. 1977.

Journal of the Acoustical Society of America, "Rare Earth Iron Octagonal Transducer"—J. L. Butler and S. J. Ciosek, May 1980, pp. 1809–1811.

Greenlaw et al., *Sonar Transducer Design Incorpoates Rare Earth Alloy*, Defense Systems Review, Nov. 1984, pp. 50–55 & Magnetostrictive Property Chart.

*Primary Examiner*—Brian S. Steinberger

*Attorney, Agent, or Firm*—Staas & Halsey

[57] ABSTRACT

A low frequency sound producer including a plurality of magnetostrictive vibrators arranged seriatim end to end to define a ring. Each vibrator unit includes a plurality of laterally related magnetostrictive rods which, in the illustrated embodiment, are formed of rare earth magnetostrictive material. Structure is provided for compressively prestressing the rods. The prestressing structure includes permanent magnets for providing a permanent magnetic bias in the rods. Coils are magnetically coupled to the rods for causing the desired magnetostriction thereof corresponding to an input AC signal applied to the coils. Opposite ends of the individual vibrator units define facial abutments in defining the continuous ring configuration. In the illustrated embodiment, the ring configuration is polygonal and the facial abutment surfaces at the ends of the units define a 60° included angle. The entire sound producer is provided with an outward enclosure of synthetic resin whereby each vibrator unit defines an enclosed water-sealed assembly.

19 Claims, 2 Drawing Sheets

FIG. 1
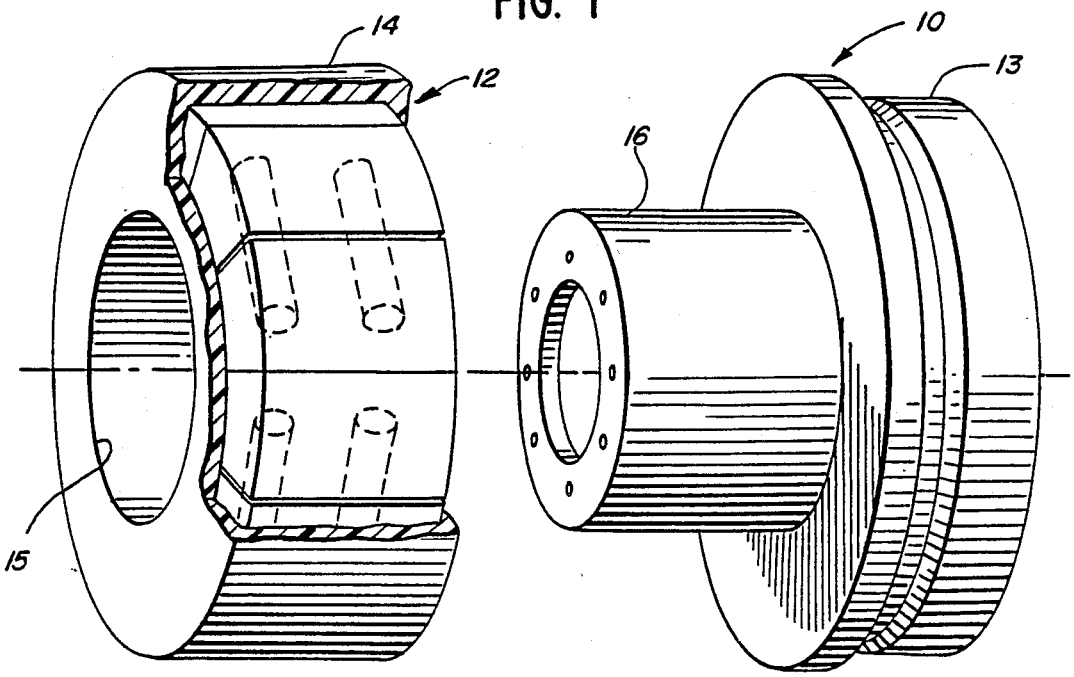
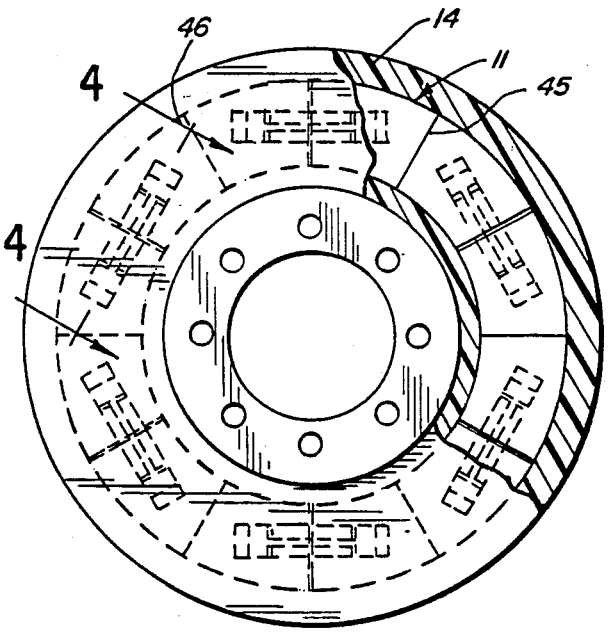
FIG. 2
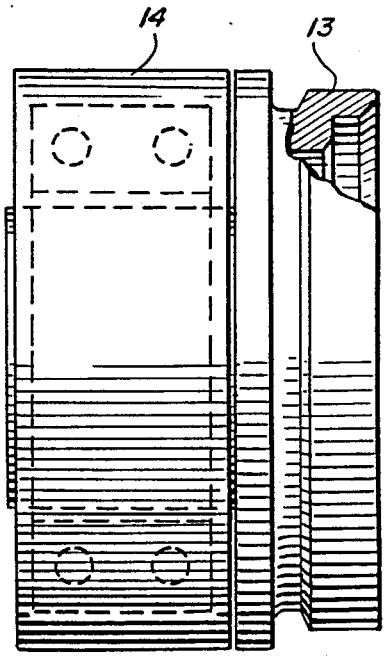
FIG. 3

LOW FREQUENCY SOUND TRANSDUCER

This is a continuation of co-pending application Ser. No. 547,109 filed on Oct. 11, 1983 now abandoned.

BACKGROUND OF THE INVENTION

1. Field of the Invention

This invention relates to sound producers and in particular to low frequency sound producers adapted for use in high pressure environments.

2. Description of the Related Art

One form of magnetostrictive transducer is illustrated in U.S. Letters Pat. No. 2,468270 of Harry F. Olson et al. As shown therein, the signal transducer is intended for use in underwater signaling systems, echo ranging systems, and the like. The transducer utilizes, as signal translating members, elements which can be tuned separately to a desired resonant frequency and which are formed as laminated members. The circuit uses a polarizing coil which conducts the magnetic flux through a magnetic plate through the laminated bar around which is closely fitted the signal coil.

Benjamin Schwartz discloses, in U.S. Letters Pat. No. 3,484,630, an ultrasonic magnetostrictive transducer element having a pair of magnets between opposed legs of U-shaped magnetic bars with coil windings disposed about each of the bars.

In the Volume 27, Number 1, January 1977 issue of *U.S. Navy Journal of Underwater Acoustics,* Robert R. Smith and James C. Logan describe the design of a transducer using rare-earth magnetostrictive materials. The transducer utilizes a plurality of magnetostrictive rods each of which is surrounded by a signal solenoid, with the rods disposed between stress plates secured together by stress bolts. The stress plates, in turn, transmit low frequency vibrations to a pair of spaced outer housing portions.

In the May 1980 issue of the *Journal of the Acoustical Society of America,* at pages 1809–1811, J. L. Butler and S. J. Ciosek disclose a rare earth iron octagonal transducer.

SUMMARY OF THE INVENTION

The present invention comprehends an improved magnetostrictive vibrator for producing low frequency sound, including a plurality of laterally related rods each formed of rare earthmagnetostrictive material, means for compressively prestressing the rods, permanent magnet means for providing a permanent magnet bias in the rods, and coil means magnetically coupled to the rods for causing magnetostriction of the rods corresponding to an input AC signal applied to the coil means.

In the illustrated embodiment, the rods are substantially rectilinear.

In the illustrated embodiment, the magnetic means comprises means compressively urged against at least one end of the rods for transmitting to the rods compressive prestressing forces.

The rods may be formed of rare earth material.

The prestressing means, in the illustrated embodiment, comprises resilient prestressing means.

In the illustrated embodiment, the vibrator is enclosed in a synthetic resin.

The sound producer further includes spacer means between the ends of the successive vibrators which are arranged end to end to define a ring, with each of the vibrators comprising a plurality of laterally related rods, each formed of rare earth magnetostrictive material.

In the illustrated embodiment, the ring is polygonal and the spacer means comprise wedge-shaped elements.

Each of the vibrators comprises a water-sealed assembly.

In one aspect, the invention comprehends the provision of a low frequency sound producer including a plurality of magnetostrictive vibrators arranged seriatim end-to-end to define a polyhedral ring, each vibrator comprising a pair of parallel spaced rods formed of rare earth magnetostrictive material, means for compressively prestressing the rods, rare earth permanent magnet means for providing a permanent magnetic bias in the rods, and coil means magnetically coupled to the rods for causing magnetostriction of the rods corresponding to an input AC signal applied to the coil means.

The illustrated embodiment, the vibrator further includes means for coupling the coil means in series.

In the illustrated embodiment, the rods are spaced in the axial direction of the ring.

The magnetostrictive vibrator of the present invention is extremely simple and economical of construction, while yet providing an improved low frequency sound source adapted for use such as in marine applications at great depths. As a result of the improved efficiency of the transducer, the size thereof may be substantially reduced from that of the prior art devices. A novel arrangement further permits the use of rare earth transducers without the need for a separate direct-current power source.

BRIEF DESCRIPTION OF THE DRAWINGS

Other features and advantages of the invention will be apparent from the following description taken in connection with the accompanying drawing wherein:

FIG. 1 is an exploded perspective view with portions broken away illustrating a magnetostrictive vibrator embodying the invention;

FIG. 2 is an end elevation of the vibrator;

FIG. 3 is a side elevation thereof with a portion broken away to illustrate in greater detail the support means for mounting the vibrator;

DESCRIPTION OF THE PREFERRED EMBODIMENT

Figure 4:
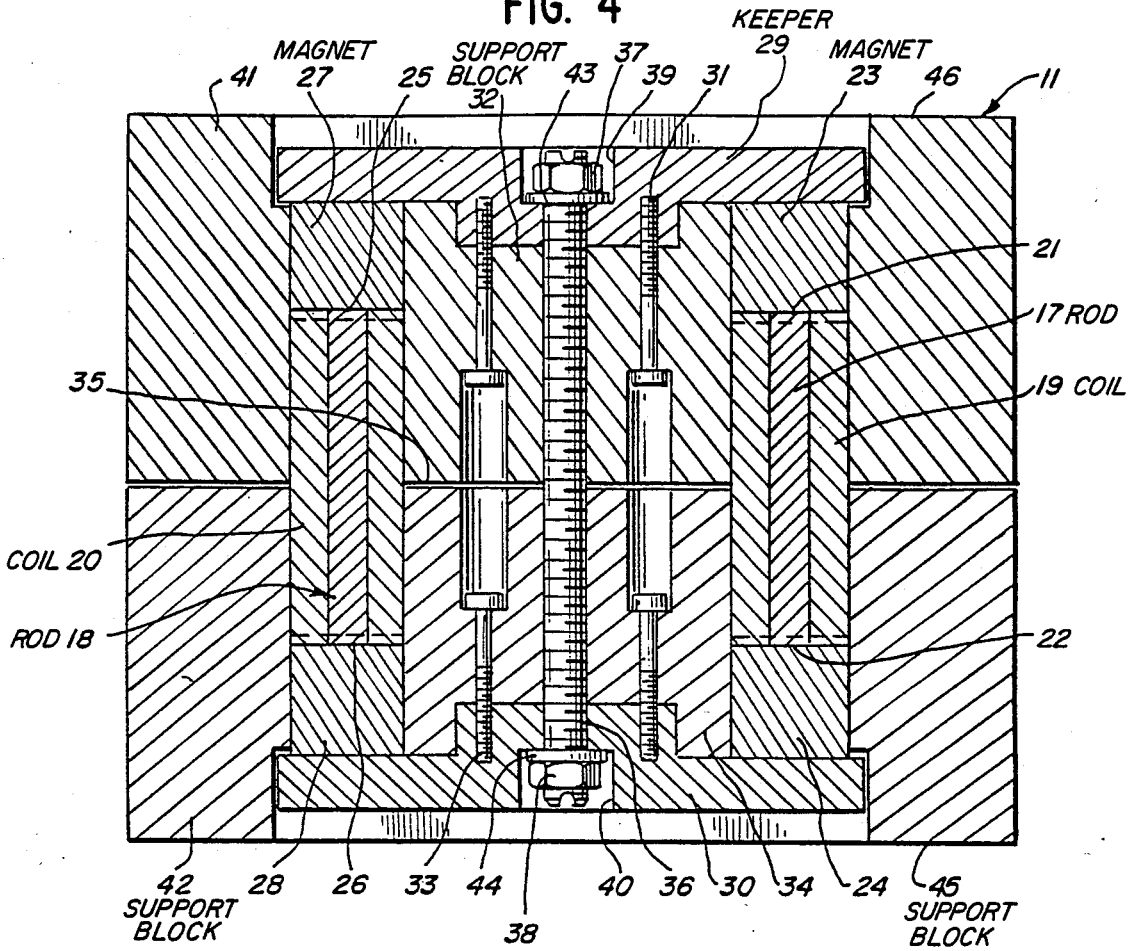
FIG. 4 is an enlarged transverse section taken substantially along the line 4—4 of FIG. 2.

In the illustrative embodiment of the invention as disclosed in the drawing, a magnetostrictive vibrator generally designated 10 comprises a plurality of individual vibrator units 11 arranged seriatim end to end to define a polyhedral ring generally designated 12. As shown in FIG. 2, in the illustrated embodiments, six such units 11 are provided forming a hexagonal ring.

The ring is arranged to be mounted on a support 13 and is advantageously adapted for use in producing low frequency vibrations or sound in environments of extremely high pressure, such as at great marine depths. The ring 11 may be encased in a suitable enclosure 14 of synthetic resin defining an axial bore 15 adapted to mount on a cylindrical extension 16 of the support 13.

Figure 5:
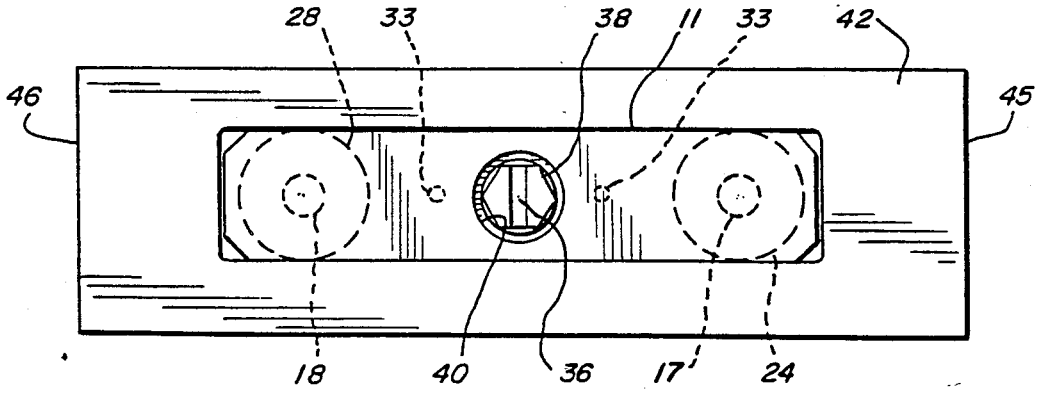
FIG. 5 is an end view of the vibrator unit illustrated in FIG. 4.

The transducer units 11 are similar and are shown in greater detail in FIGS. 4 and 5. More specifically, each unit comprises an individual vibrator which is a self-contained water-sealed unit vibrating under the influence of laterally related magnetostrictive rods 17 and 18, extending axially within surrounding annular coils 19 and 20, respectively. The opposite ends 21 and 22 of rod 17 abut permanent magnets 23 and 24, respectively. The opposite ends 25 and 26 of rod 18 abut permanent magnets 27 and 28, respectively.

Magnets 23 and 27, in turn, are abutted by a bridging magnetic keeper 29 and magnets 24 and 28 are abutted by a similar abridging magnetic keeper 30. Secured to keeper 29 by a plurality of cap screws 31 is a support block 32 and secured to keeper 30 by a plurality of similar cap screws 33 is a similar support block 34.

As seen in FIG. 4, the support blocks 32 and 34 define therebetween a gap 35, with the keepers 29 and 30, and thus, supports blocks 32 and 33, urged toward each other by a stress wire 36 connected at its opposite ends to securing nuts 37 and 38 received in outwardly opening recesses 39 and 40 in keepers 29 and 30, respectively. By suitable tightening of the tension nuts, prestressing of the magnetostrictive rods 17 and 18 is effected whereby vibratory elongation and contraction of the rods by the application of alternating current through the coils 19 and 20 is transmitted to the keepers 29 and 30 and, in turn, to outer portions 41 and 42 of the support blocks 32 and 34, respectively.

In the illustrated embodiment, the prestressing is made to be elastic by means of Belleville washers 43 and 44 urged by the nuts 37 and 38, respectively, against the keeper plates 29 and 30.

In the illustrated embodiment, the gap 35 between the supports 32 and 34 is approximately 0.01", and thus, the supports, including outer portions 41 and 42, are caused to vibrate with a total maximum permissible excursion of approximately 0.02".

In the illustrated embodiment, the rods 17 and 18 are formed of rare earth material, and more specifically, are formed of TERFENOL D, comprising a compound $Tb_{.28}Dy_{.72}Fe_2$.

The vibrator 10 is advantageously adapted for use in producing low frequency sound such as in marine applications at great depths. By arranging the individual vibrator units in ring form, a high degree of stability is provided, while yet high efficiency in the production of the desired low frequency sound is effected. The individual units are substantially free-flooded so that water pressure on the exterior of the transducer is effectively substantially completely offset by the pressure on the interior thereof.

By utilizing a permanent magnet bias, the ring vibrator minimizes heating, increasing the performance of the transducer. By utilizing the close-packed hexagonal array configuration, further efficiency in the overall sound production is obtained.

In the illustrated embodiment, the support bodies are shown, as in FIG. 2, to have inclined end surfaces 45 and 46. As will be obvious to those skilled in the art, however, if it is desired to maintain the end surfaces 45 and 46 orthogonal or parallel to each other, additional spacers (not shown) may be utilized between the end surfaces of the contiguous vibrator units.

It is found that the improved ring vibrator 10 produces a higher sound level for its size than the prior art transducers in view of the permissible large vibrational displacement. Thus, the vibrator provides a substantial improvement in applications where small size, high efficiency low frequency sound producers are desired.

The foregoing disclosure of specific embodiments is illustrative of the broad inventive concepts comprehended by the invention.

What we claim is:

1. A magnetostrictive vibrator for producing low frequency sound, said vibrator comprising:

a plurality of laterally related rods each formed of rare-earth magnetostrictive material and each having a cross section;

permanent magnets for providing a permanent magnet bias in said rods; and coil means magnetically coupled to said rods for causing magnetostriction of the rods corresponding to an input AC signal applied to said coil means; and wherein said permanent magnets comprise means compressively urged against at least one end of the rods for transmitting to the rods compressive pre-stressing forces.

2. The magnetostrictive vibrator of claim 1 wherein said rods are substantially rectilinear.

3. The magnetostrictive vibrator of claim 1 wherein said rods are formed of a compound comprising $Tb_{.28}Dy_{.72}Fe_2$.

4. The magnetostrictive vibrator of claim 1 wherein said prestressing means comprises resilient prestressing means.

5. The magnetostrictive vibrator of claim 1 wherein said vibrator is enclosed in a synthetic resin.

6. A magnetostrictive vibrator for producing low frequency sound, said vibrator comprising:

a plurality of laterally related rods each formed of rare earth magnetostrictive material;

permanent magnets for providing a permanent magnet bias in said rods;

coil means magnetically coupled to said rods for causing magnetostriction of the rods corresponding to an input AC signal applied to said coil means; and means for compressively prestressing said rods, said prestressing means including magnetic keepers for conducting flux between said coil means.

7. A magnetostrictive vibrator for producing low frequency sound, said vibrator comprising:

a plurality of laterally related rods each formed of rare earth magnetostrictive material;

permanent magnets for providing a permanent magnet bias in said rods;

coil means magnetically coupled to said rods for causing magnetostriction of the rods corresponding to an input AC signal applied to said coil means; and means for compressively prestressing said rods, prestressing means including magnetic keepers for conducting flux between said coil means through said permanent magnets.

8. A low frequency sound producer, comprising:

at least three magnetostrictive vibrators arranged seriatim end-to-end to define a ring, each vibrator comprising:

a plurality of laterally related rods each formed of rare-earth magnetostrictive material and each having a cross section;

permanent magnets for providing a permanent magnetic bias in said rods;

coil means magnetically coupled to said rods for causing magnetostriction of the rods corresponding to an input AC signal applied to said coil means; and means defining facial abutments at opposite ends of successive vibrators; and wherein said permanent magnets comprise means compressively urged against at least one end of the rods for transmitting to the rods compressive pre-stressing forces.

9. The low frequency sound producer of claim 8 wherein said ring is polygonal.

10. The low frequency sound producer of claim 8 wherein said ring is polygonal and said facial abutment means also define a 60° included angle.

11. The low frequency sound producer of claim 8 wherein said sound producer is provided with an enclosure coating of synthetic resin.

12. The low frequency sound producer of claim 8 wherein each said vibrator comprises a water-sealed assembly.

13. The low frequency sound producer of claim 8 wherein said rods are formed of a compound comprising $Tb_{.28}Dy_{.72}Fe_2$.

14. A low frequency sound producer, comprising:

at least three magnetostrictive vibrators arranged seriatim end-to-end to define a polyhedral ring, each vibrator comprising:

a pair of spaced apart rods in parallel with one another formed of rare-earth magnetostrictive material and each rod having a cross section;

rare-earth permanent magnets for providing a permanent magnetic bias in said rods; and coil means magnetically coupled to said rods for causing magnetostriction of the rods corresponding to an input AC signal applied to said coil means; and wherein said permanent magnets comprise means compressively urged against at least one end of the rods for transmitting to the rods compressive pre-stressing forces.

15. The low frequency sound producer of claim 14 wherein each vibrator further includes means for coupling the coil means in series.

16. The low frequency sound producer of claim 14 wherein said rods are spaced in the axial direction of the ring.

17. A low frequency sound producer comprising a plurality of magnetostrictive vibrators arranged seriatim end-to-end to define a polyhedral ring, each vibrator comprising:

a pair of parallel spaced rods formed of rare earth magnetostrictive material;

means for compressively prestressing said rods;

rare earth permanent magnet means for providing a permanent magnetic bias in said rods;

coil means magnetically coupled to said rods for causing magnetostriction of the rods corresponding to an input AC signal applied to said coil means; and keeper means for coupling the coil means in series.

18. A low frequency sound producer comprising a plurality of magnetostrictive vibrators arranged seriatim end-to-end to define a polyhedral ring, each vibrator comprising:

a pair of parallel spaced rods formed of rare earth magnetostrictive material;

means for compressively prestressing said rods;

rare earth permanent magnet means for providing a permanent magnetic bias in said rods;

coil means magnetically coupled to said rods for causing magnetostriction of the rods corresponding to an input AC signal applied to said coil means; and keeper means for coupling the coil means in series, said keeper means being arranged to direct compressive forces against the opposite ends of the rods.

19. A magnetostrictive vibrator, comprising:

a rare earth rod having a first cross section;

a permanent magnet urged against at least one end of said rod, providing a permanent magnetic bias in said rod; and a coil coupled to said rod causing magnetostriction of said rod corresponding to an input signal; and wherein said permanent magnet comprise means compressively urged against at least one end of the rod for transmitting to the rod compressive prestressing forces.

* * * * *

UNITED STATES PATENT AND TRADEMARK OFFICE

CERTIFICATE OF CORRECTION

PATENT NO. : 4,907,209

DATED : March 6, 1990

INVENTOR(S) : Sewell et al.

It is certified that error appears in the above-identified patent and that said Letters Patent is hereby corrected as shown below:

Front Page, Under "U.S. Patent Documents" list --4,158,964 6/79 McCrea et al.--.

Front Page, Under "Other Publications" list --N.A. Anderson, Cobalt rare-earth high energy permanent magnets, Electronic Components and Applications, Vol. 5, No. 4, September--.

Col. 4, line 8, "material and each hav-" s/b --material;--;

line 9, delete in its entirety;

line 61, "material and each hav-" s/b --material;--;

line 62, delete in its entirety.

Col. 5, line 27, "material and each rod having a cross section" s/b --material;--.

Col. 6, line 33, "rod having a first cross section;" s/b --rod;--;

line 38, "signal;" s/b --signal--.

UNITED STATES PATENT AND TRADEMARK OFFICE

CERTIFICATE OF CORRECTION

PATENT NO. : 4,907,209

DATED : March 6, 1990

INVENTOR(S) : Sewell et al.

It is certified that error appears in the above-identified patent and that said Letters Patent is hereby corrected as shown below:

The following claims were inadvertently omitted:

20. The vibrator of claim 1, wherein said rods have a cross section, and said permanent magnets abut ends of said rods and have a cross section larger than the cross section of said rods.

21. The vibrator of claim 10, wherein said rods have a cross section, and said permanent magnets abut ends of said rods and have a cross section larger than the cross section of said rods.

22. The vibrator of claim 16, wherein said rods have a cross section, and said permanent magnets abut ends of said rods and have a cross section larger than the cross section of said rods.

Signed and Sealed this

Twenty-fourth Day of December, 1991

*Attest:*

HARRY F. MANBECK, JR.

*Attesting Officer*

*Commissioner of Patents and Trademarks*